US006058754A

United States Patent [19]

Svejkovsky et al.

[11] Patent Number: 6,058,754

[45] Date of Patent: May 9, 2000

[54] ROLLING TRAIN FOR ROLLING FLAT STEEL

[75] Inventors: Ulrich Svejkovsky, Wuppertal; Hans-Jürgen Nowak, Kamp-Lintfort; Georg Engel, Düsseldorf, all of Germany

[73] Assignee: SMS Schloemann-Siemag Aktiengesellschaft, Düsseldorf, Germany

[21] Appl. No.: 09/052,420

[22] Filed: Mar. 31, 1998

[30] Foreign Application Priority Data

Apr. 7, 1997 [DE] Germany ..... 197 14 216

[51] Int. Cl.[7] ..... B21B 3/10

[52] U.S. Cl. ..... 72/225

[58] Field of Search ..... 72/224, 225, 226, 72/229, 234, 366.2, 365.2; 29/527.7

[56] References Cited

U.S. PATENT DOCUMENTS

| | | | |
|---|---|---|---|
| 4,386,511 | 6/1983 | Morita | 72/366.2 |
| 4,860,426 | 8/1989 | Engel et al. | 72/225 |
| 4,918,964 | 4/1990 | Engel et al. | 72/225 |
| 5,327,761 | 7/1994 | Piasecki et al. | 72/225 |

FOREIGN PATENT DOCUMENTS

| | | | |
|---|---|---|---|
| 0265757 | 5/1988 | European Pat. Off. . | |
| 3635440 | 4/1987 | Germany . | |
| 3635440 | 8/1995 | Germany . | |
| 0050903 | 4/1980 | Japan | 72/229 |

*Primary Examiner*—Joseph J. Hail, III
*Assistant Examiner*—Rodney Butler
*Attorney, Agent, or Firm*—Friedrich Kueffner

[57] ABSTRACT

A rolling train for rolling flat steel using universal stands having—instead of vertical rolls—adjustable support members for pairs of loose vertical rollers arranged in the areas of the stands. The rolling train includes a roughing rolling group with vertical two-high stand or universal stand and horizontal two-high stand and a compact rolling group composed of two tandem universal stands and arranged following the roughing rolling group, wherein the two universal stands of the compact rolling group are equipped with non-driven adjustable vertical rollers.

1 Claim, 3 Drawing Sheets

ROLLING TRAIN FOR ROLLING FLAT STEEL

BACKGROUND OF THE INVENTION

1. Field of the Invention

The present invention relates to a rolling train for rolling flat steel using universal stands having—instead of vertical rolls—adjustable support members for pairs of loose vertical rollers arranged in the areas of the stands.

2. Description of the Related Art

German Patent 36 35 440 discloses a universal stand in which different widths of a flat steel blank and the necessity of a clean processing of the edges of the blank are taken into consideration by arranging in front of and behind the horizontal rolls of the universal stand pairs of vertical rollers which are mounted in support yokes, wherein the support yokes are pivotable about vertical axes located centrally and at a distance from the common axis plane of the vertical rollers. This known arrangement, in which the vertical rollers are not driven, is supposed to make it possible to move the vertical rollers as closely as necessary to the roll gap of the horizontal rolls and to apply the necessary rolling pressure for working the edges of the flat steel blank without the danger of a deformation of the blank over the width thereof.

The universal stands of this type have in the past always been used in conventional universal beam rolling trains which were composed of a two-high reversing roughing stand with long roll body lengths of about 2.5 m and at least one universal stand reversing group and, more recently, a XH-tandem reversing group, and which made it possible to combine the rolling of flat steels with the production of sectional steel or beams.

The procedure of flat steel rolling in these trains has the following disadvantages:

There are limitations of the roughing rolling operation on the two-high reversing roughing stand with the long roll body lengths necessary for sectional steel rolling with respect to rolling force and rolling tolerances because of the substantial bending of the rolls. The necessary high pass numbers do not make it possible to carry out a combined operation with an appropriate slab/strand casting plant. The temperature conditions also limit the number of passes in the roughing stand and, thus, the achievable final thickness which must serve as the initial pass thickness for the following universal rolling and, therefore, requires more rolling work in the universal rolling step. The greater rolling thicknesses which are produced in the two-high reversing stand cannot be sufficiently edged during roughing rolling at the edges as would be desirable in wide flat steels or universal wide flat steels. Edging in the two-high reversing stand is only possible for such a time as the rolling thickness and rolling width permit it that the flat section is placed upright and an on-edge edging of the flat section is possible.

SUMMARY OF THE INVENTION

Therefore, it is the primary object of the present invention, starting from the prior art discussed above, to provide another possibility of use for the known rolling trains composed of a roughing rolling group with vertical two-high stand or universal stand and a horizontal two-high stand and a compact rolling group with at least two universal stands, wherein these rolling trains have in the past been used together with additional edging stands primarily for rolling beams and other sectional steel, preferably from continuously cast initial sections.

In accordance with the present invention, the rolling train includes a roughing rolling group with vertical two-high stand or universal stand and horizontal two-high stand and a compact rolling group composed of two tandem universal stands and arranged following the roughing rolling group, wherein the two universal stands of the compact rolling group are equipped with non-driven adjustable vertical rollers.

Rolling trains of this type can be operated, for example, in such a way that the initial section is edged in the vertical stand or the universal stand of the roughing rolling group and is subsequently finish-rolled in successive passes and reversing passes in the tandem stands of the compact rolling groups while simultaneously working the side edges of the section by means of the vertical rollers which initially act to shape the edges and later act to guide the edges.

The solution according to the present invention avoids the disadvantages of the above-described rolling trains which operate together with, for example, a beam production, possibly in combination with a continuous casting plant using cast flat cross-sections having dimensions which are close to the final dimensions. Roughing rolling is now possible in a horizontal stand with short roll body lengths which can be adapted precisely to the maximum rolling width of the flat steel. The short roll body lengths of the horizontal rolls make it possible to produce greater reductions with an already very small initial pass thickness; on the other hand, even in the case of greater final thicknesses, the vertical two-high stand of the roughing rolling group produces well rolled edges. When further rolling is carried out in the tandem universal stands, the smaller initial pass thickness produced by roughing rolling make it possible to continue rolling at advantageous temperatures, namely higher temperatures. This increases the productivity of the finish rolling operation in the tandem universal stands of the compact rolling group and this, in turn, makes it possible to carry out a combined operation strand casting plant and rolling train.

It is also possible to arrange two or more universal finishing stands following the tandem universal stands. Such a rolling train can be operated in such a way that in the tandem universal stands of the compact rolling group the section is not subjected to reversing passes after the successive passes, but is directly conveyed to the downstream universal finishing stands and is finish-rolled in these universal finishing stands, again without reversing passes.

In accordance with a further feature of the present invention, the vertical rollers may be supported in the adjustable vertical bearing chocks of the universal stands; also, the vertical rollers may have grooved incisions adjusted to the side edges of the flat steel section.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
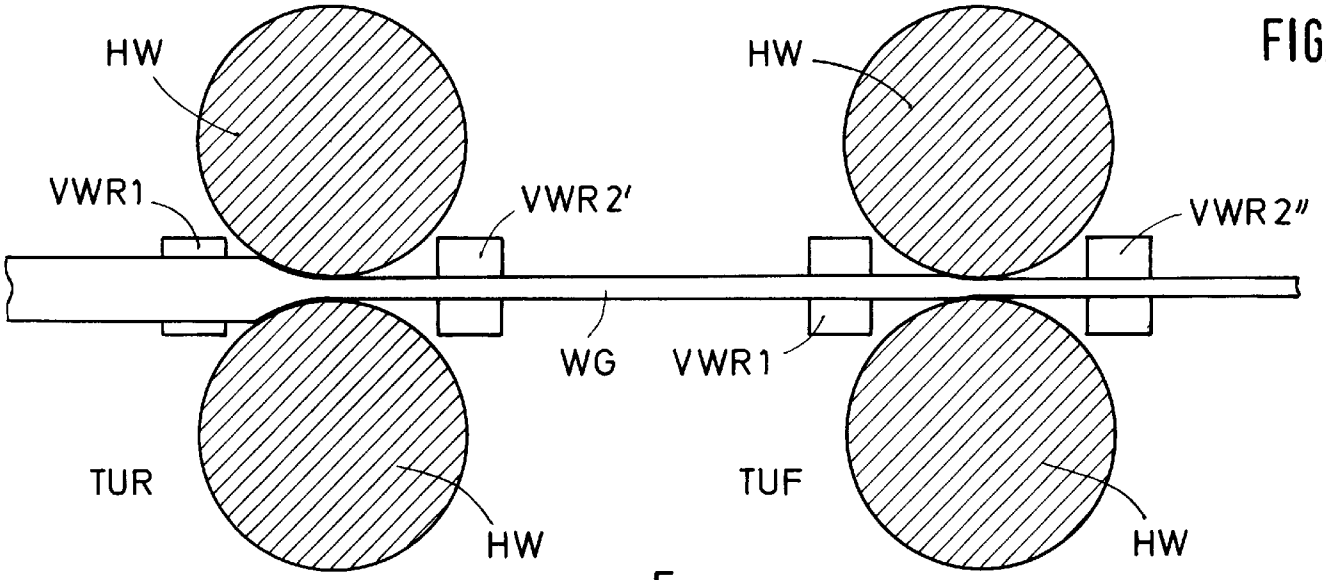
FIG. 1 s a side view, partially in section, of the universal stands of the compact rolling group.
Figure 3:
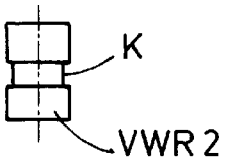
FIG. 3 is a side view of a vertical roller.
Figure 2:
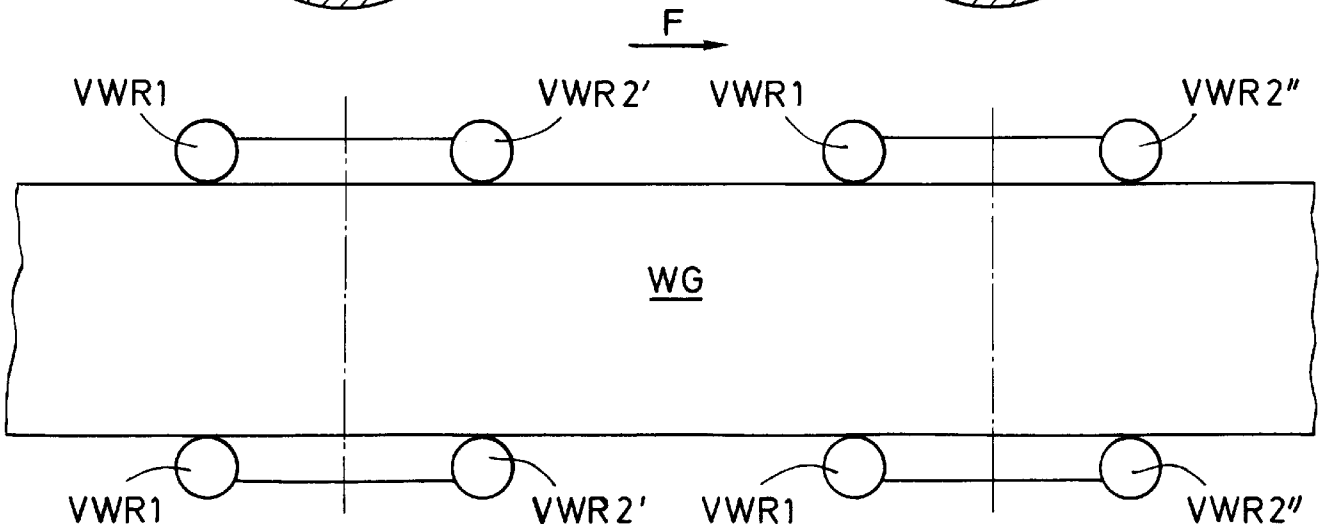
FIG. 2 is a top view of the universal stands of FIG. 1.

As illustrated in FIGS. 1 and 2 of the drawing, the two vertical rollers VWR1 and VWR2' of the tandem universal stand TUR and the corresponding vertical rollers VWR1 and VWR2" of the second tandem universal stand TUF are arranged closely adjacent to the roll gap formed by the horizontal rolls HW. In contrast to the vertical rollers VWRl, which may have a smooth-cylindrical periphery, the vertical rollers VWR2' and VWR2" may have a groove K, as seen in FIG. 3. This groove K, which makes it possible to produce a better edge formation of the rolled strand WG, must be adapted for the first pass of the rolled material WG in the direction of arrow F to the respective thickness reduction initially in the tandem universal stand TUR and then in the tandem universal stand TUF. In the following passes and reversing passes, this groove K can only serve for the lateral guidance of the rolled material WG.

Figure 4:
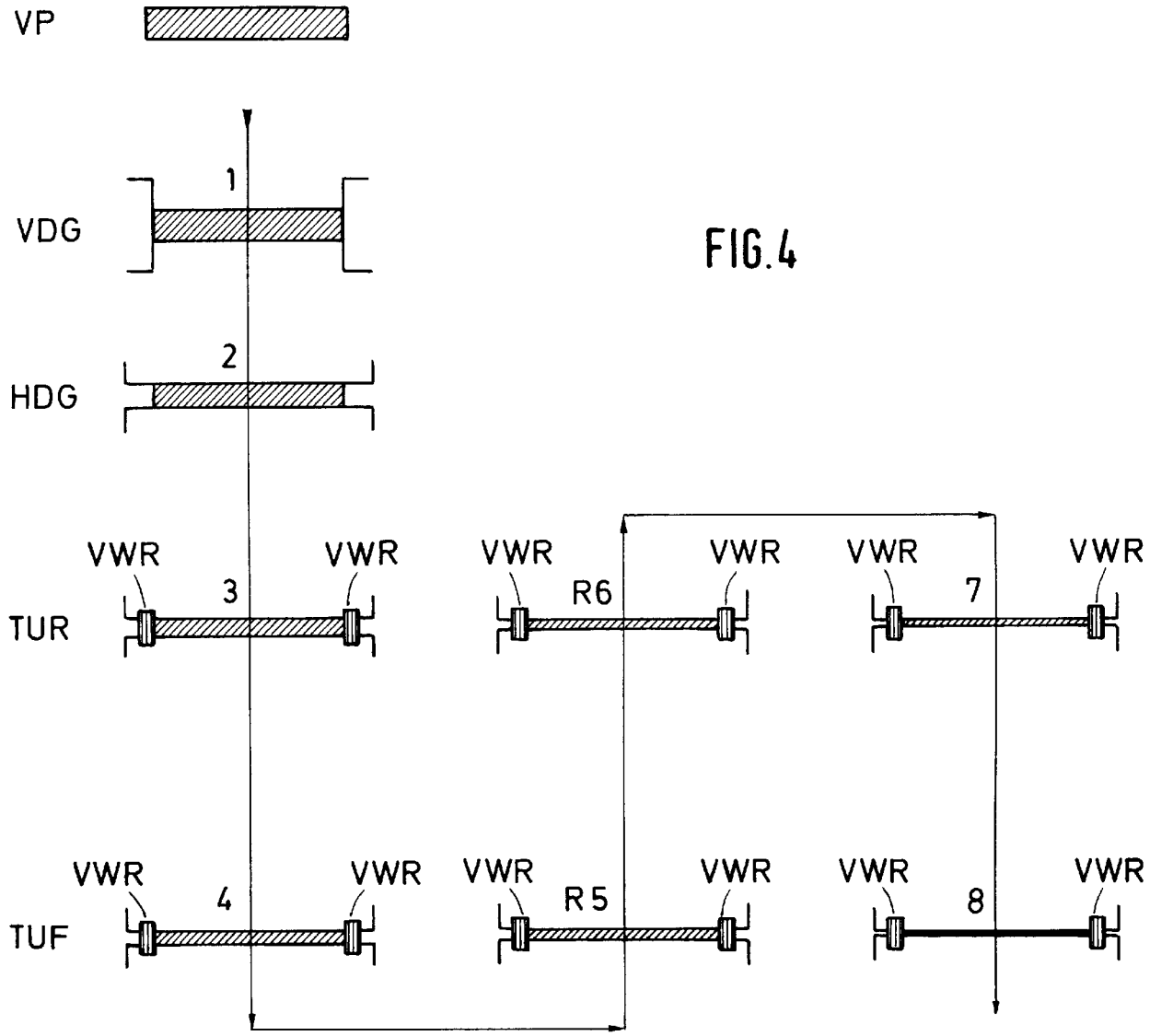
FIG. 4 is a schematic illustration of a pass schedule.

In accordance with the pass schedule shown in FIG. 4, an initial section VP having a rectangular cross-section is edged in a first pass 1 in the vertical two-high stand VDG and is subsequently rolled so as to increase its width in a second pass 2 in the horizontal two-high stand HDG to such a dimension that the resulting section can be subjected to a pass 3 in the first tandem universal stand TUR of the compact rolling group. In this pass 3, the two side edges of the section are acted upon by the pairs of vertical rollers VWR as well as in the following pass 4 in the second tandem universal stand TUF. This is followed by two additional reversing passes R5 and R6 in the reverse direction through both stands, followed by the final passes 7 and 8. After pass 8 in the last tandem universal stand TUF, the flat steel rolled material is finish-rolled.

Figure 5:
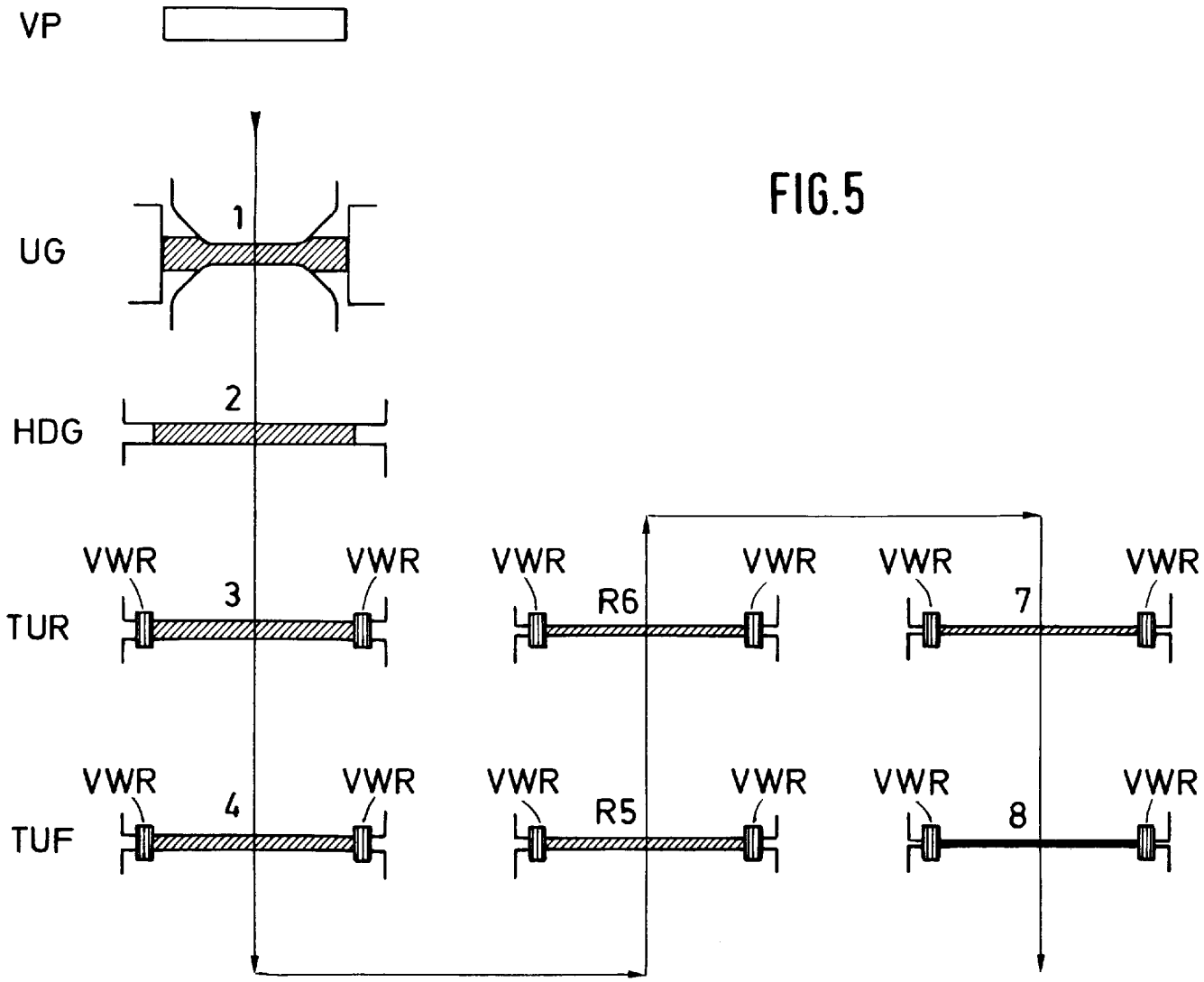
FIG. 5 is a schematic illustration of another pass schedule.

The pass sequence according to FIG. 5 differs from that of FIG. 4 only in that in the roughing group a universal stand UG is used instead of the vertical two-high stand, wherein the universal stand UG carries out rough-rolling of the initial section VP in the first pass 1 and the width increase is effected in the following pass 2 in the horizontal 2-high stand HDG of the roughing group.

The invention is not limited by the embodiments described above which are presented as examples only but can be modified in various ways within the scope of protection defined by the appended patent claims.

We claim:

1. In a rolling train for rolling flat steel in a compact rolling group for rolling sections of continuously cast initial sections, wherein the compact rolling group includes one of a roughing group including a vertical two-high stand and a horizontal two-high stand and a roughing group including a universal stand and a horizontal two-high stand, and wherein the compact rolling group further includes first and second tandem universal stands, wherein the improvement comprises that the first and second tandem universal stands each have pairs of first and second non-driven loose vertical rollers, wherein the first vertical roller has a smooth cylindrical periphery and the second vertical roller has in a smooth periphery thereof a grooved incision, and wherein the grooved incision has a height corresponding to a height of the flat steel wherein said grooved incision is configured to act to initially shape an edge of the flat steel and to subsequently guide the edge during the first pass of the flat steel.

* * * * *